US007025624B2

(12) United States Patent
Kiyota et al.

(10) Patent No.: US 7,025,624 B2
(45) Date of Patent: Apr. 11, 2006

(54) PARTS HALF-MOUNTING PREVENTION CONNECTION BLOCK WITH DETECTION WALL FOR DETECTING A HALF-FITTED STATE OF A MOUNTED PART AND ELECTRIC CONNECTION BOX PROVIDED WITH SAME

(75) Inventors: Hirotaka Kiyota, Ogasa-gun (JP); Yoshihiko Nakahama, Toyota (JP); Kazuhiro Kusuyama, Toyota (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/883,970

(22) Filed: Jul. 6, 2004

(65) Prior Publication Data

US 2005/0048834 A1 Mar. 3, 2005

(30) Foreign Application Priority Data

Jul. 4, 2003 (JP) ..... P2003-191836

(51) Int. Cl.
*H01R 3/00* (2006.01)

(52) U.S. Cl. ..... 439/489

(58) Field of Classification Search ..... 439/489, 439/536, 76.2, 533, 633, 677; 174/53
See application file for complete search history.

(56) References Cited

U.S. PATENT DOCUMENTS

| | | | | |
|---|---|---|---|---|
| 4,134,636 | A * | 1/1979 | Kleinatland et al. | 439/535 |
| 5,926,351 | A * | 7/1999 | Abe | 360/132 |
| 6,309,248 | B1 * | 10/2001 | King | 439/535 |
| 2005/0032418 | A1 * | 2/2005 | Urbes et al. | 439/535 |

FOREIGN PATENT DOCUMENTS

| | | | |
|---|---|---|---|
| JP | 4-111112 | U | 9/1992 |
| JP | 5-41052 | U | 6/1993 |
| JP | 6-43318 | U | 6/1994 |
| JP | 7-272607 | A | 10/1995 |
| JP | 9-55158 | A | 2/1997 |
| JP | 11-243284 | A | 9/1999 |
| JP | 11-298165 | A | 10/1999 |

* cited by examiner

*Primary Examiner*—Chandrika Prasad
(74) *Attorney, Agent, or Firm*—Sughrue Mion, PLLC

(57) ABSTRACT

A parts-half-mounting prevention connection block includes: a block body; a parts-mounting portion provided to the block body, on which a part is adapted to be mounted; and a detection wall having substantially the same height as a height of the part to be mounted, provided to the block body.

10 Claims, 4 Drawing Sheets

PARTS HALF-MOUNTING PREVENTION CONNECTION BLOCK WITH DETECTION WALL FOR DETECTING A HALF-FITTED STATE OF A MOUNTED PART AND ELECTRIC CONNECTION BOX PROVIDED WITH SAME

BACKGROUND OF THE INVENTION

This invention relates to a parts half-mounting prevention connection block capable of positively detecting an incompletely-mounted condition of parts, such as a relay and a fuse, with a simple structure, and the invention also relates to an electric connection box provided with this connection block.

FIG. 5 shows one conventional parts half-mounting prevention connection box.

This connection box 41 comprises a connection box main portion 42, and a cover 43. A plurality of electrical parts 44 such as fuses and relays are mounted on the connection box main portion 42, and abutment piece portions 45 for the electrical parts 44 are formed on and extend downwardly from the cover 43. In case any of the electrical parts 44 is in a half-mounted condition (half-fitted condition), this electrical part 44 projects higher, and when the cover 43 is closed, the corresponding abutment piece portion 45 abuts against this electrical part 44. Therefore, the cover 43 can not be closed, so that the half-mounted condition of the electrical part 44 is detected, However, this structure has a problem that the cover 43, made of a synthetic resin, is elastically deformed because of its elasticity, and absorbs the projecting height of this half-mounted electrical part 44, so that the precision of the half-mounting detection is lowered.

Therefore, there has been proposed a parts half-mounting prevention connection box 51 (see Patent Literature 1) in which projectable detection members 55 are retainingly mounted on a cover 53 as shown in FIG. 6, and in case any of electrical parts 54 such as fuses is half-mounted on a connection box main portion 52, an abutment portion 55*a* of the corresponding detection member 55 abuts against this electrical part 54 when the cover 53 is closed, and therefore the retaining of this detection member 55 is canceled, and this detection member 55 projects outwardly from the cover 53, so that this half-mounted condition is detected.

In addition to the above structure, there has been proposed a structure in which when electrical parts such as relays are mounted on a connection box main portion, these electrical parts are locked thereto by respective retaining members provided on the connection box main portion (see, for example, Patent Literature 2).

Patent Literature 1

JP-UM-A-5-41052

Patent Literature 2

JP-UM-6-43318

In the above conventional structure (FIG. 6), however, a half-mounted condition of the electrical parts 54 can not be detected unless the cover 53 is closed, and therefore there have been encountered problems that the electrical part 54 is disengaged from the connection box main portion at a stage before the cover 53 is closed, that the detection precision is lowered when the gap between the cover 53 and each electrical part 54 is large; and that the structure of the cover 53, including the detection members 55, is complicated, so that the cost increases.

In the case of the structure in which the electrical parts are retained on the connection box main portion by the respective retaining members, the fixing of the electrical member can be positively effected, but with respect to the half-mounting of the electrical parts, it must be confirmed whether or not each retaining member has performed the intended retaining function, and much time and labor are required for this confirmation. And besides, a cost and a space are required for providing the retaining members, and this has invited a problem that the structure tends to become bulky and costly.

SUMMARY OF THE INVENTION

In view of the above problems, it is an object of the invention to provide a parts half-mounting prevention connection block capable of easily and positively detecting a half-mounted condition of electrical parts (such as a relay and a fuse), electronic parts or others, with a simple structure, before attaching a cover. Another object is to provide an electric connection box provided with such a connection block.

In order to solve the aforesaid object, the invention is characterized by having the following arrangement.

(1) A parts-half-mounting prevention connection block comprising:

a block body;

a parts-mounting portion provided to the block body, on which a part is adapted to be mounted; and a detection wall having substantially the same height as a height of the part to be mounted, provided to the block body.

(2) The parts half-mounting prevention connection block according to (1), the detection wall is disposed vicinity of the part mounted on the parts-mounting portion.

(3) The parts half-mounting prevention connection block according to (1), wherein the detection wall is formed by an extension portion extending from one side wall portion of the block body.

(4) The parts half-mounting prevention connection block according to (1), wherein a plurality of the parts-mounting portions are provided to the block body, and the height of the respective detection walls varies according to the heights of the parts mounted respectively on the parts-mounting portions.

(5) An electric connection box comprising a parts half-mounting prevention connector block including:

a block body;

a parts-mounting portion provided to the block body, on which a part is adapted to be mounted; and a detection wall having substantially the same height as a height of the part to be mounted, provided to the block body.

(6) The electric connection box according to (5), wherein a wall portion of a connection box body, disposed in opposed relation to the detection wall, has substantially the same height as the height of the detection wall.

DETAILED DESCRIPTION OF PREFERRED EMBODIMENTS

A preferred embodiment of the present invention will now be described in detail with reference to the drawings.

Figure 1:
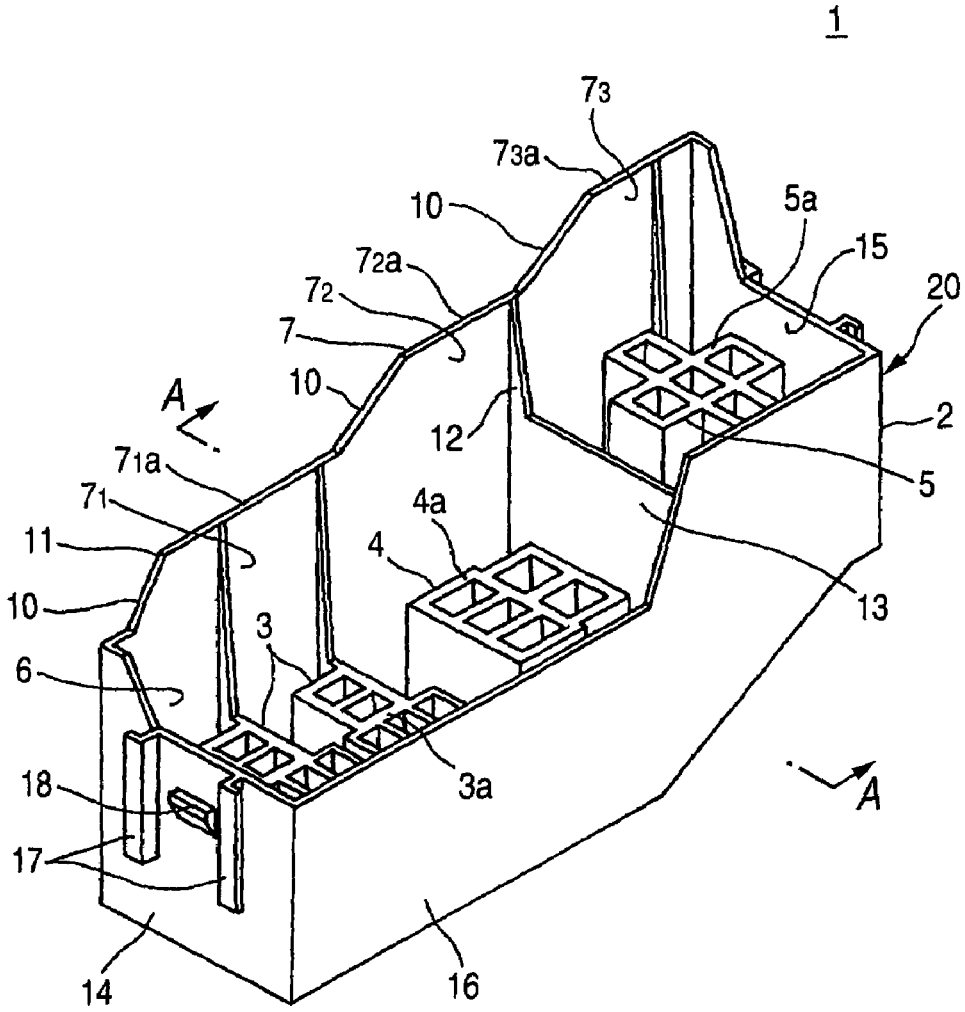
FIG. 1 is a perspective view showing one preferred embodiment of a connection block of the present invention.

FIG. 1 shows one preferred embodiment of a parts half-mounting prevention connection bock of the invention.

This parts half-mounting prevention connection block (hereinafter referred to merely as "connection block") 1 includes a peripheral wall 2 serving as a surrounding outer wall, and a plurality of (three kinds in this embodiment) relay mounting portions 3 to 5, and this connection block is characterized in that a relay half-mounting prevention detection wall 7 is integrally formed on and extends from one side wall 6 forming part of the peripheral wall 2.

Figure 2:
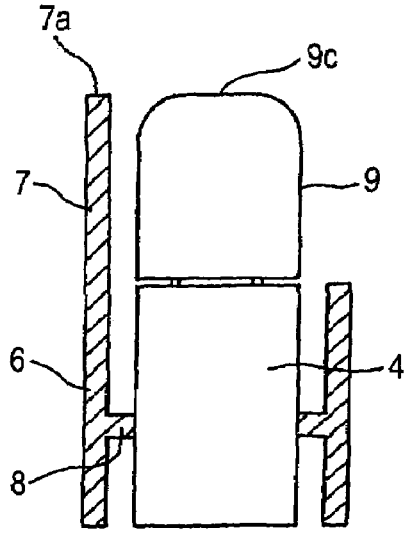
FIG. 2 is a cross-sectional view taken along the line A—A of FIG. 1, showing a condition in which a part is mounted on the connection block.
Figure 3:
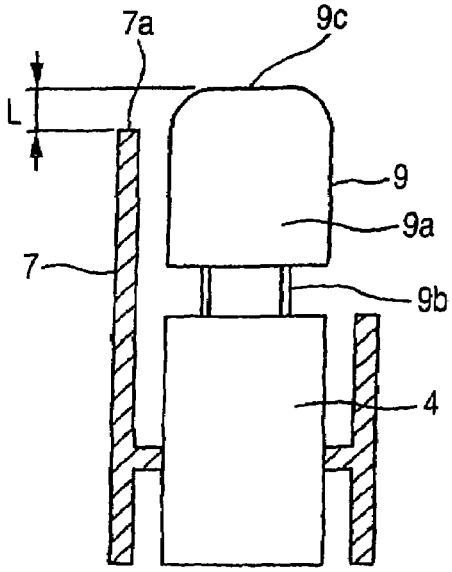
FIG. 3 is a cross-sectional view, showing a half-mounted condition of the part.

The relay mounting portions 3 to 5 are connected to the peripheral wall 2 through horizontal partition walls 8 (FIG. 2) and vertical partition walls (not shown). A block body 20 molded of a synthetic resin is formed by the peripheral wall 2, the partition walls 8 and others. Terminals (not shown), such as wire-connected terminals and relay terminals connected to bus bars, are received within the relay mounting portions 3 to 5, and are connected respectively to terminals 9*b* of relays 9 (FIG. 3).

The relay mounting portions 3, provided at one end portion of the connection block, is low, and the relay mounting portion 5, provided at the other end portion, is high, and the intermediate relay mounting portion 4 is disposed at a level (height) between the relay mounting portions 3 and 5. Upper surfaces (mounting surfaces) 3*a* to 5*a* of these relay mounting portions are sequentially different in height in a stair-like manner. The rate of increase of the height of the mounting surfaces 3*a* to 5*a* does not need to be constant at all. The relay mounting portions 3 to 5 are arranged in a juxtaposed manner (in a row) in a horizontal direction, and are spaced from one another at predetermined intervals.

According to the heights of the relay mounting portions 3 to 5, the height of the detection wall 7 is gradually varying to provide a generally smooth rectangular wave-like contour. The detection wall 7 includes a plurality of (three kinds of) detection wall portions $\mathbf{7}_1$ to $\mathbf{7}_3$ having their respective heights corresponding respectively to the relays 9 (FIG. 2). Horizontal upper edges $\mathbf{7}_1$a and $\mathbf{7}_2$a of the detection wall portions $\mathbf{7}_1$ and $\mathbf{7}_2$ are interconnected by a slanting edge portion 10 and also the horizontal upper edges $\mathbf{7}_2$a and $\mathbf{7}_3$a of the detection wall portions $\mathbf{7}_2$ and $\mathbf{7}_3$ are interconnected by a slanting edge portion 10. Each of the upper edges $\mathbf{7}_1$a to $\mathbf{7}_3$a and the corresponding slanting edge portion 10 are interconnected at an intersection point 11 which is formed into a smoothly arcuate shape. Each of the upper edges $\mathbf{7}_1$a to $\mathbf{7}_3$a is disposed at a level (height) which is equal to the height of the corresponding relay mounting surfaces 3*a*, 4*a*, 5*a* plus a height of a relay main portion (that portion of the relay except the terminals 9*b*) 9*a*.

Namely, the height of the detection wall 7 is so determined that when each relay 9 (designated by reference numeral 9 for convenience' sake although different kinds of relays are mounted) is mounted on the corresponding relay mounting portion 3, 4, 5 as shown in FIG. 2 (which is a cross-sectional view taken along the line A—A of FIG. 1), the upper edge 7*a* of the detection wall 7 and an upper end 9*c* of the corresponding relay 9 can lie in a common horizontal plane (that is, the height of the relay 9 can be equal to the height of the detection wall 7).

The relays (parts) 9 are located in parallel, closely spaced relation to the detection wail 7, and the fact that the upper end 9*c* of each relay 9 and the upper edge 7*a* of the detection wall 7 are disposed at the same level (height) can be easily and positively detected by the worker, engaged in an assembling operation, with the eyes and by the touch. As shown in FIG. 1, the upper edges ($\mathbf{7}_1$a to $\mathbf{7}_3$a) of any two adjacent ones of the detection wall portions $\mathbf{7}_1$ to $\mathbf{7}_3$ are smoothly interconnected by the slanting edge portion 10, and therefore the worker can quickly and efficiently detect a half-mounted condition of the relay by smoothly sliding his finger(s) from the slanting edge portion 10 onto the upper edge $\mathbf{7}_1$a, $\mathbf{7}_2$a, $\mathbf{7}_3$a.

In case the relay 9 is in a half-mounted condition as shown in FIG. 3, the relay 9 projects upwardly beyond the upper edge 7*a* of the detection wall 7, so that a step L is formed between the upper edge 7*a* of the detection wall 7 and the upper end 9*c* of the relay 9. Therefore, this half-mounted condition can be easily and positively detected with the eyes and by the touch. FIG. 3 shows an example in which the relay 9 projects in a relatively large amount, but even when the projecting amount is smaller than that shown in FIG. 3, the existence of such a step can be easily and positively detected by the touch.

In FIG. 1, the relays 9 of different kinds and sizes are mounted on the respective relay mounting portions 3 to 5, and a half-mounted condition of each relay 9 can be easily and positively detected by the detection wall 7. The two relays of the same kind are mounted respectively on the front-side relay mounting portions 3 in a juxtaposed manner, and a half-mounted condition of these relays can be efficiently detected through the common detection wall portion $\mathbf{7}_1$.

The detection wall 7 is reinforced by vertical ribs 12 so that it will not be warped or deformed. A partition wall 13, extending from the rib 12, is formed between the intermediate relay mounting portion 4 and the other end-side relay mounting portion 5, thereby positively preventing the warping, etc., of the detection wall 7. The other portion of the peripheral wall 2 than the detection wall 7 is lower than the detection wall 7, and the relay mounting surfaces 3*a* to 5*a* are disposed slightly lower than their corresponding wall portions 14 to 16. The peripheral wall 2 of a rectangular annular shape is defined by the vertical front and rear wall portions 14 and 15 and the vertical left and right side wall portions 6 and 7. A pair of sliding engagement portions 17 and a engagement projection 18, disposed therebetween, are formed on each of the front and rear wall portions 14 and 15. These members 17 and 18 are provided for fixedly mounting the connection block 1 on an electric connection box.

Figure 4:
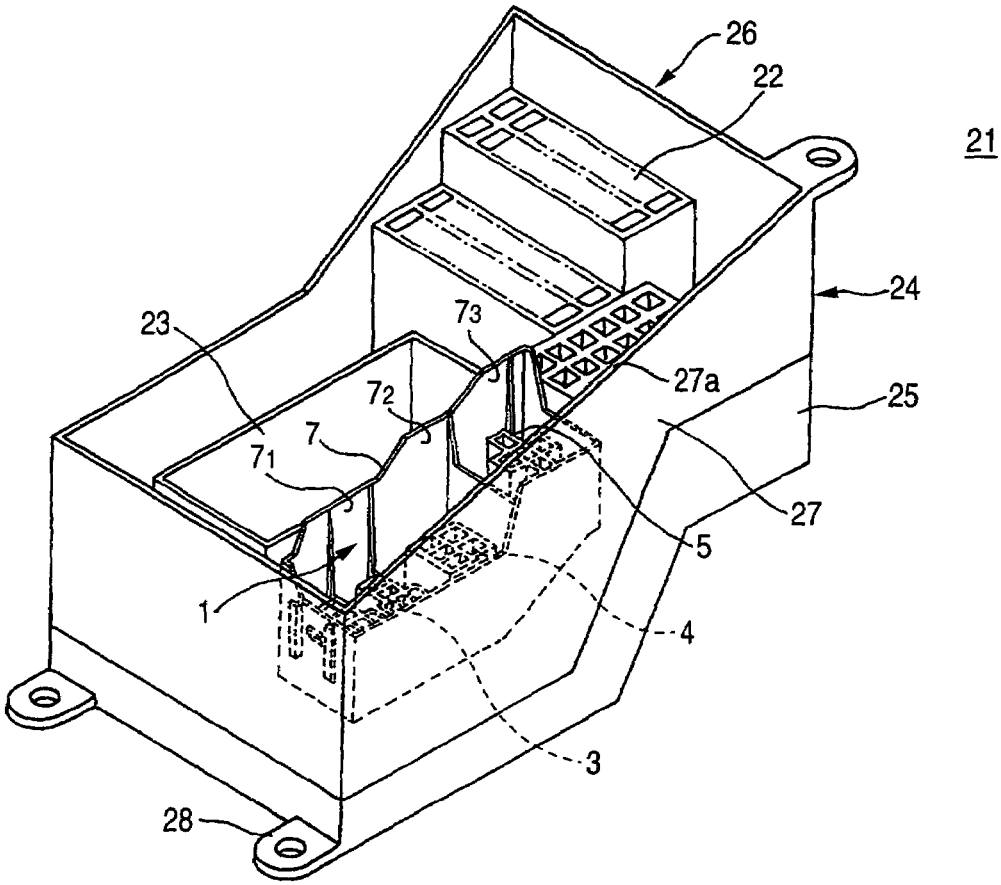
FIG. 4 is a perspective view showing one preferred embodiment of an electric connection box of the invention.
Figure 5:
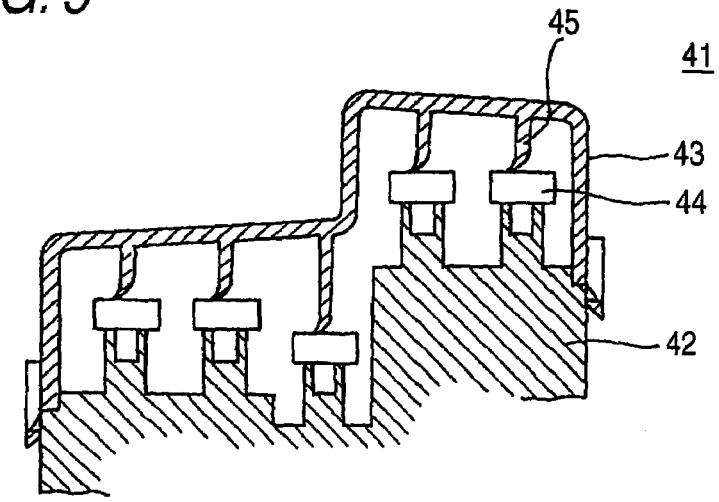
PRIOR ART FIG. 5
FIG. 5 is a vertical cross-sectional view of one conventional electric connection box, having a parts half-mounting detection function.
Figure 6:
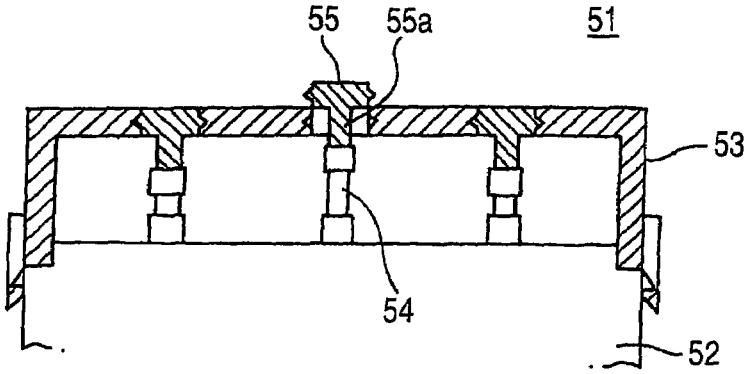
PRIOR ART FIG. 6
FIG. 6 is a vertical cross-sectional view of another conventional electric connection box having a parts half-mounting detection function.

FIG. 4 shows one preferred embodiment of the electric connection box, and this electric connection box 21 comprises a large-size casing 24 of a synthetic resin for receiving the connection block 1, fuse blocks 22, a connector block 23 and others in a fixed manner, and a lower cover 25 and an upper cover (not shown) which are joined to the casing 24. A connection box body 26 is formed by the blocks 1, 22 and 23, the casing 24 and the cover 25, and the electric connection box 21 is formed by the connection box body 26, fuses, the relays 9, a connector and others.

The connection block 1 is disposed along one slanting side wall (wall portion) 27 of the casing 24, and one side wall 16 (FIG. 1) of the connection block 1 is disposed lower than the side wall 27 of the casing 24, and the detection wall 7 of the connection block 1, formed integrally with the other side wall 6 (FIG. 1), is disposed generally at the same height as that of the slanting side wall 27 in opposed relation thereto. Namely, an imaginary straight line, interconnecting the starting end 11 (FIG. 1) of the upper edge of the front-side lowest detection wall portion $7_1$, the starting end of the upper edge of the intermediate wall portion $7_2$ and the starting end of the upper edge of the rear-side highest wall portion, $7_3$, is disposed generally at the same height as that of an upper edge 27*a* of the slanting side wall 27 in parallel relation thereto.

With this construction, the worker can accurately detect the position of the upper edge of the detection wall 7 and the positions of the upper ends of the relays 9 (FIG. 2) with the eyes and by the touch without obstruction by the side wall 27 of the casing 24. And besides, the slanting side wall 27 of the casing 24 serves as an auxiliary detection wall (Even when only the position of the upper edge of the slanting side wall 27 and the position of the upper end of each relay 9 are confirmed, a half-mounted condition of the relay 9 can be detected accurately to a certain degree), and whether or not each relay 9 is in a half-mounted condition can be confirmed from both (right and left) sides of the electric connection box 21.

The electric connection box 21 is fixed to a body of an automobile or the like through bracket portions 28. A half-mounted condition of the relays 9 can be easily and positively detected in any of the condition in which the connection block 1 is provided alone, the condition in which the connection block 1 is mounted in the connection box body 26 and the condition in which the electric connection box 21 is fixed to the vehicle body or the like.

A half-mounted condition of the relays 9 can be easily and accurately detected by extending part of the wall portion 2 of the connection block 1. With this simple structure, the cost of the connection block 1, as well as the cost of the electric connection box 21 having this connection block mounted thereon, can be made low.

In the embodiment of FIG. 1, the heights of the relay mounting portions 3 to 5 are different from each other. However, even in the case where the relay mounting portions have the same height while only the heights of the relays 9 are different, the same effect can be achieved by the detection wall 7 having the stair-like configuration as shown in FIG. 1. In the embodiment of FIG. 4, although the connection block 1 is releasably mounted within the connection box body 26 to provide the electric connection box 21, the connection block 1 can be integrally molded on the connection box body 26 (the casing 24) to provide the electric connection box 21.

In the embodiment of FIG. 1, the detection wall 7 is formed on and extends from one side wall portion 6 in such a manner that this detection wall 7 and the side wall portion 6 lie in a common plane. However, in the case where the wall portion 6 is not disposed near to the relay mounting portions 3 to 5, the detection wall 7 can be integrally formed on the wall-portion 6 through a step portion or the like (not shown) in such a manner that this detection wall 7 is disposed near to the relays 9. Instead of arranging the plurality of relay mounting portions 3 to 5 in a stair-like manner, these relay mounting portions can be arranged in a staggered manner in the vertical direction, in which case the upper edge of the detection wall 7 is indented so as to correspond to this arrangement. Although the detection wall 7 is provided in corresponding relation to the plurality of relay mounting portions, the detection wall can be provided in corresponding relation to one relay mounting portion, and this is also effective.

The detection wall 7 can be used for detecting a half-mounted condition of other electrical parts than the relays, such as blade-type fuses and box-type fusible links, a half-fitted (half-mounted) condition of various kinds of connectors and a half-mounted condition of electronic parts such as various semiconductor elements and various control parts. The connection block, instead of being incorporated in the electric connection box, can be used alone as a relay block, a fuse block or a connector block.

As described above, according to the invention, by comparing the height of the detection wall with the heights of the parts, a half-mounted condition of each part can be easily and positively detected, and when any part is in a half-mount, this part is pushed to be completely mounted in position, thereby positively preventing the half-mounted condition of the part. Therefore, the quality of the connection block, such as a relay block and a fuse block, is enhanced. And besides, a half-mounted condition of the parts can be detected with the simple construction, that is, with the detection wall, and therefore the cost of the connection block can be made low.

According to the invention, the precision of the detection of half-mounting of the parts is enhanced, and the effect of enhancing the quality of the connection block is more positively achieved.

According to the invention, the detection wall can be easily formed at a low cost, and therefore the cost of the connection block can be made as low as the cost of the conventional connection block. And besides, the detection wall can be additionally formed merely by modifying a mold for molding the conventional connection block, and therefore the production cost is low.

According to the invention, half-mounted conditions of the plurality of parts of different mounting heights can be efficiently examined generally at the same time with the eyes, the touch or others, and therefore a half-insertion examining operation can be efficiently effected simultaneously when the parts are mounted in the connection block, and the productivity of the connection blocks is enhanced.

According to the invention, when the parts such as relays and fuses are mounted in the electric connection box, a half-mounted condition of the parts can be easily and positively detected by the detection wall of the connection block, and therefore the reliability of electrical connection of the electric connection box is enhanced.

According to the invention, a half-mounted condition of the parts can be positively detected by both of the wall portion of the connection box body and the detection wall of the connection block, or from the opposite sides of the connection box body, and therefore the quality (electrical connection reliability) of the electric connection box is further enhanced.

What is claimed is:

1. A parts-half-mounting prevention connection block comprising:

a block body having a bottom surface and a plurality of side walls projecting upwardly from said bottom surface;

a parts-mounting portion provided on the bottom surface of the block body, on which a part is adapted to be mounted; and a detection wall having substantially the same height as a height of the part to be mounted, provided to the block body, wherein the detection wall is formed by an extension portion extending from one side wall portion of the plurality of side walls to another side wall portion at an opposite side of the block body.

2. The parts half-mounting prevention connection block according to claim 1, the detection wall is disposed in the vicinity of the part mounted on the parts-mounting portion.

3. The parts half-mounting prevention connection block according to claim 1, wherein the detection wall is formed such that the height of the detection wall is higher than the height of the plurality of side walls.

4. The parts half-mounting prevention connection block according to claim 1, wherein a plurality of the parts-mounting portions are provided to the block body, and the height of the respective detection walls varies according to the heights of the parts mounted respectively on the parts-mounting portions.

5. An electric connection box comprising a parts half-mounting prevention connector block including:

a block body having a bottom surface and a plurality of side walls projecting upwardly from said bottom surface;

a parts-mounting portion provided on the bottom surface of the block body, on which a part is adapted to be mounted; and a detection wall having substantially the same height as a height of the part to be mounted, provided to the block body, wherein the detection wall is formed by an extension portion extending from one side wall portion of the plurality of side walls to another side wall portion at an opposite side of the block body.

6. The electric connection box according to claim 5, wherein a wall portion of a connection box body, disposed in opposed relation to the detection wall, has substantially the same height as the height of the detection wall.

7. The electric connection box according to claim 5, wherein the detection wall is formed such that the height of the detection wall is higher than the height of the plurality of side walls.

8. The parts half-mounting prevention connection block according to claim 4, wherein the plurality of the parts-mounting portions are respectively connected by slanting edge portions.

9. The electric connection box according to claim 1, wherein a plurality of the parts-mounting portions are provided to the block body, and the height of the respective detection walls varies according to the heights of the parts mounted respectively on the parts-mounting portions.

10. The parts half-mounting prevention connection block according to claim 9, wherein the plurality of the parts-mounting portions are respectively connected by slanting edge portions.

* * * * *